US005477801A

United States Patent [19]

Lawrence

[11] Patent Number: 5,477,801

[45] Date of Patent: Dec. 26, 1995

[54] SAFETY ADAPTOR FOR STANDARD DOCK CLEAT

[76] Inventor: Alan P. Lawrence, 314 Walnut St., Newport Beach, Calif. 92663

[21] Appl. No.: 364,670

[22] Filed: Dec. 27, 1994

[51] Int. Cl.[6] ..... B63B 21/04

[52] U.S. Cl. ..... 114/218; D8/356

[58] Field of Search ..... 114/218; D8/356

[56] References Cited

U.S. PATENT DOCUMENTS

| | | | |
|---|---|---|---|
| D. 120,131 | 10/1871 | Trulsen | D54/11 |
| D. 179,328 | 11/1956 | Stewart | D54/11 |
| D. 191,885 | 12/1961 | Corlett | D8/356 |
| D. 227,216 | 6/1973 | Miller | D8/356 |
| D. 239,258 | 3/1976 | Faul | D8/232 |
| D. 255,419 | 6/1980 | Hume | D8/382 |
| D. 299,311 | 1/1989 | Whitley, II | D8/356 |
| D. 300,721 | 4/1989 | Whitley, II | D8/356 |
| D. 301,683 | 6/1989 | Whitley, II | D8/356 |
| 2,011,532 | 8/1935 | Wanser, Sr. | 114/218 |
| 2,870,733 | 11/1959 | Winther . | |
| 4,270,478 | 6/1981 | Kafka | 114/218 |
| 4,344,378 | 8/1982 | Martin | 114/218 |
| 4,685,500 | 8/1987 | Silvia | 114/218 |

*Primary Examiner*—Jesus D. Sotelo

[57] ABSTRACT

A device used in conjuction with a standard dock cleat (20) which provides protection from the horizontally protruding horns of the dock cleat and also provides an additional surface for guiding a rope or docking line. The protection is provided by a smooth sloping surface (13) aligned in front of and parrallel to the protruding horn so that a person's foot moving towards the end of the horn is deflected away. The additional guiding surface (12) is positioned opposite the dock cleat's guiding surface so that a person can guide the boat from either direction without removing the rope. On a typical dock cleat, if the boat moves past the cleat it is neccessary to remove the line from the cleat and place it back on the cleat at the other end. Normal installation would require two safety adaptors for each dock cleat, placed on opposite sides of the cleat to provide protection from each horn.

1 Claim, 2 Drawing Sheets

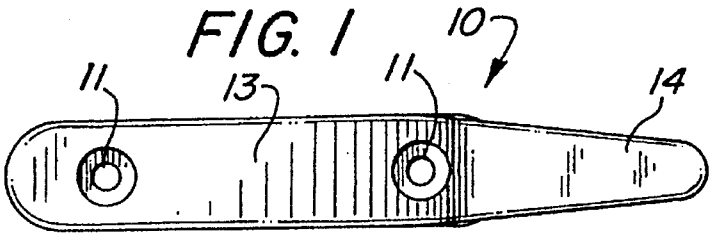
FIG. 1
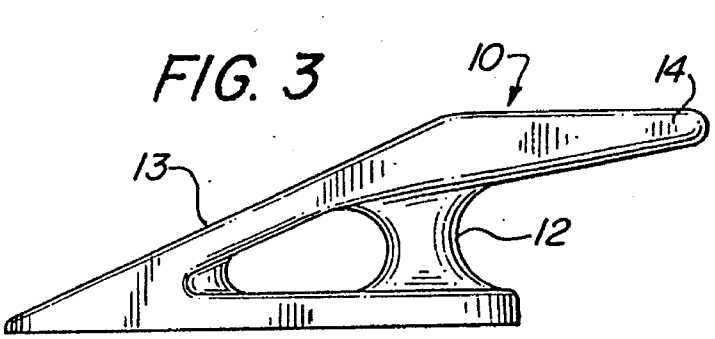
FIG. 2
FIG. 3
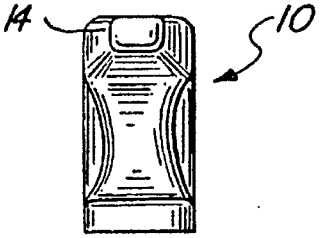
FIG. 4
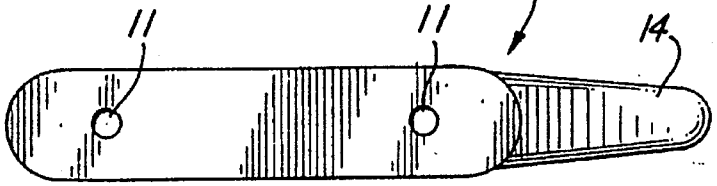
FIG. 5

SAFETY ADAPTOR FOR STANDARD DOCK CLEAT

BACKGROUND-CROSS REFERENCE TO RELATED APPLICATION

A patent application filed concurrently with this application, entitled "Combination Dock Cleat and Chock".

1. Background-Field of Invention

This invention relates to the standard cleat used on boat docks and marinas to secure a boat to the dock, specifically to a device which will make such cleats safer and easier to use.

2. Background-Description of Prior Art

Although there have been many types of dock cleats patented, nearly all dock cleats in use in the United States today are the type which utilizes two horizontally protruding horns, extending in opposite directions. These two horns, attached to a common base, provide a surface which a line or rope can be tied or wrapped around, the other end of the rope being attached to the boat. The horizontally protruding horns are generally blunted, with a diameter of about ½ inch and are two or three inches above the surface of the dock, depending on the size of the cleat.

This type of cleat is simple and effective. The way it is used is generally understood by anyone who has any boating experience, and even a person unfamiliar with it can usually determine an effective way to secure a line or rope to the cleat.

One problem with this type of cleat is that the horizontally protruding horns must be oriented so that it is possible for a person walking along the dock to strike or kick the end of the cleat with his foot, which is usually painful and can cause serious injury.

This problem has been previously addressed in two ways.

One approach, for which a number of patents have been issued, makes use of folding or retractable cleats. Folding or retractable cleats do eliminate any danger of injury when they are in the retracted position, that is, when they are not being used. In order to use them, however, they must be exposed, resulting in the same hazard as standard cleats.

Because they involve moving parts they are more complicated and relatively expensive. Moving parts tend to jam or become inoperable either as a result of corrosion or due to the abuse they are subjected to. Installation is much more complicated since recesses must usually be cut into the dock. Also, some people attempting to use the cleats may not know how to "unfold" them.

The other approach used by previous inventors has been to redesign the cleat or to create a new cleat design which will effectively hold the boat but which has no protruding ends. Although many of these designs may work quite well, the average boater would not know how to use them. The education in their use that is required and the fact that they are not what people are used to is undoubtedly the major cause of the lack of commercial success of any cleat design which departs significantly from the standard type currently in use.

OBJECTS AND ADVANTAGES

Accordingly, several objects and advantages of the invention are as follows:

(a) The safety adaptor shields the point of the horizontally protruding horn so it cannot be directly struck by the foot of a person walking on the dock. The adaptor itself has a smooth sloping surface on the side of the adaptor which would be kicked or struck. This surface is designed to deflect the foot, thereby preventing injury, (b) The safety adaptor does not change how the dock cleat is used. The basic configuration and the method of securing the line to the cleat remain the same so that anyone familiar with a standard dock cleat will have no trouble using a dock cleat with the safety adaptors.

(c) The adaptor is design to be used with existing dock cleats which are already installed, thereby reducing costs and simplifying installation.

(d) There are no moving parts to stick, jam or become inoperable due to corrosion, a particular problem in a salt-water environment.

(e) The adaptor is equally effective whether the dock cleat is in use or not, and does not interfere with normal use of the dock cleat.

(f) The curved inner surface of the adaptor provides an additional surface on which to apply force to the line to help secure the boat, allowing the force to be applied in either direction without removing the line from the dock cleat.

DRAWING FIGURES

FIGS. 1 to 5 show a typical safety adaptor for a standard dock cleat. FIG. 1 is a top plan view of a safety adaptor.

FIG. 2 is a left side elevational view of a safety adaptor.

FIG. 3 is a front elevational view of a safety adaptor.

FIG. 4 is a right side elevational view of a safety adaptor.

FIG. 5 is a bottom plan view of a safety adaptor.

FIG. 6 is a isometric view of two safety adaptors and a typical dock cleat show in the arrangement in which they are to be installed and used.

REFERENCE NUMERAL IN DRAWINGS

10 a typical safety adaptor

Figure 6:
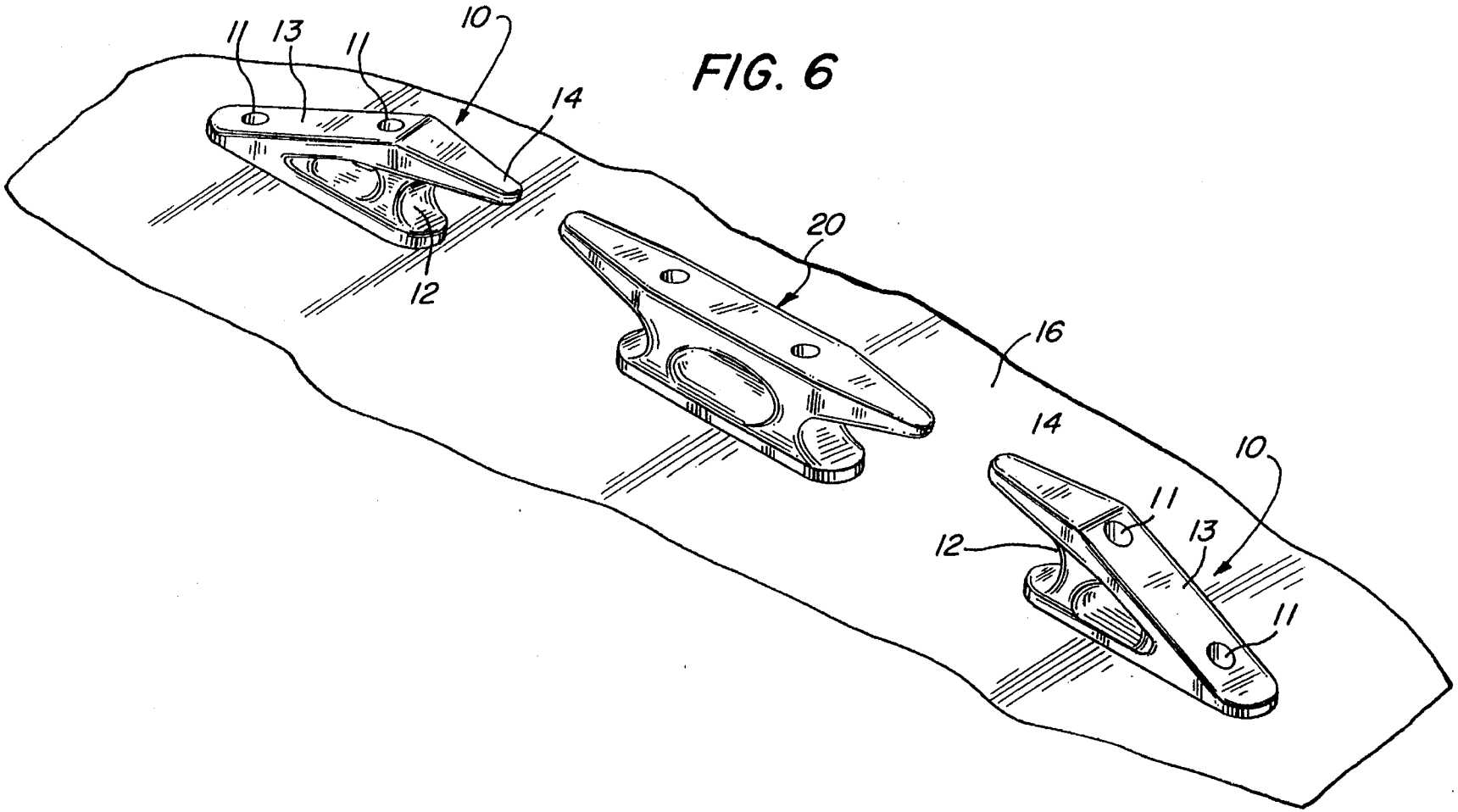
FIG. 6 shows two safety adaptors and a typical dock cleat in the configuration in which they are to be installed

11 holes for bolts used to secure adaptor to dock

12 curved inner surface for guiding rope

13 smooth sloping surface to deflect foot

14 horizontally protruding horn

16 the surface of the dock to which the adaptors are attached

20 a typical dock cleat

DESCRIPTION-FIG. 1 TO 5

FIG. 1 to 5 show a typical safety adaptor 10. The normal size of such a device would be two or three inches high, a inch or so wide and several inches long. The height and width should be the same as that of the dock cleat it is to be installed with. The range of dimensions described above will fit dock cleats in most marinas, although some applications require dock cleats which can be considerably larger.

The adaptors can be made of any material strong enough to secure the boat and compatible with an outdoor marine environment, i.e., any material which is used to make dock cleats. Nearly all dock cleats are made with galvanized steel, although stainless and other metals, plastics, and even wood are also used.

The end of the safety adaptor which faces the dock cleat, consists of a horizontally protruding horn 14 with a smooth, curved surface 12 below it to help guide the rope. This rope, the other end of which is attached to a boat, can be drawn around or across surface 12 to provide mechanical advantage and support, resulting in better control of the rope and the boat. The general configuration of this side of the adaptor is designed to be similar to that of the dock cleat which the adaptor will face.

Protruding horn 14 of the safety adaptor and the corresponding horn of the dock cleat are separated by a distance of two or three times the diameter of the largest rope expected to be used on a dock cleat of that size. On a typical recreational boat marina this distance would be about two inches.

The other end of the safety adaptor, the end facing away from the dock cleat, consists of a smooth, sloped surface 13 with no edges or corners which could injure someone's foot. The surface is designed to deflect the foot without causing injury.

The adaptor is normally secured to the dock by two lag bolts or through bolts, so holes 11 are provided for that purpose. Typically, these bolt holes are countersunk so the heads of the bolts can be installed flush with the top surface of the adaptor.

OPERATION-FIG. 6

A typical embodiment of the invention is shown in FIG. 6. A typical dock cleat 20 is shown between two safety adaptors 10. A typical boat dock or marina will have numerous dock cleats located around any place a boat is to be secured. Lines or ropes are fastened to the boat and then wrapped over and around the two horizontally protruding horns and the two curved inner surfaces below the horns. In addition, the curved inner surfaces are often used to guide the ropes as the boat is pulled into position.

The dock cleats are normally located so that the horizontal horns extend parallel to the edge of the dock, and therefore are pointing towards the feet of a person walking along the dock, and that person is swinging his feet towards the point of the horn as he walks. Due to the activity and visual distractions often found in a boating environment, a person walking on a dock sometimes swings his foot directly into the point of the horn on the dock cleat, which is usually painful and can cause injury.

By installing a safety adaptor on each side of the dock cleat as shown in FIG. 6, the point of the horn of the dock cleat is shielded from a walker's swinging foot. The horizontally protruding horns of both the adaptor and the cleat are facing each other, approximately two inches apart in a typical installation, which virtually eliminates the possibility of someone's foot striking directly against either protruding horn.

On the end of the safety adaptor opposite the dock cleat, the end which is exposed to a person's foot, a smooth, sloped surface is provided to deflect the foot away from the dock cleat, minimizing the chance of injury.

A second safety adaptor is installed on the other side of the dock cleat. Again, the protruding horns of the adaptor and the cleat are facing each other, with the smooth, sloped end of the adaptor facing outward. This prevents injury when the safety adaptor/dock cleat installation is struck from either end as a person walks along the dock.

Striking the cleat or adaptor from the side, perpendicular to the edge of the dock is far less likely. Generally docks are quite narrow and can be crossed in one or two steps. A person does not normally travel perpendicular to the edge of the dock, and in the event they did, they would usually be very aware of the edge of the dock and would not be "walking" but only taking a short step or two. And, in any case, there are no protruding horns sticking out in that direction.

Below the protruding horn on the safety adaptor is a smooth, curved surface. This the curved inner surface provides an additional surface which can be used to provide mechanical advantage and to guide the rope or line being used to pull the boat into position. This surface is similar to the surface below the horn of the dock cleat. The dock cleat already provides two surfaces for this purpose, one below each horn and facing in opposite directions. On a normal dock cleat, one surface or the other is used to guide the line, depending on whether the boat is behind or in front of the cleat. However, if one surface is being used and the boat moves past the cleat it is necessary to switch the line to the other surface, which means the line must be removed from the cleat and moved to the other side, which results in temporary lose of control of the line. With the safety cleat installed, an opposing surface is locating directly across from the one on the dock cleat, so the boat can be controlled from either direction without removing the line.

The two safety adaptors can be installed on the dock in the same manner as the dock cleat, normally by two lag bolts or through bolts extending through the cleat or adaptor and into the dock.

SUMMARY, RAMIFICATION AND SCOPE

The safety adaptor for a typical dock cleat greatly reduces the possibility of injury that can be caused by kicking or striking the horizontally protruding horns of the dock cleat by providing a smooth, sloping surface to shield the protruding horn and deflect the foot from it.

It also provides an additional surface to provide mechanical advantage and support for a line, and to help guide the line and control movement of the boat at the other end of the line. It is simple to install and designed to be used with existing dock cleats. There are no moving parts and it does not alter the method of using the standard dock cleat.

Although nearly all dock cleats utilize two horizontally protruding horns and have the same general configuration there can be considerable variation in relative proportions, surface angles, the radius of curves and corners, etc. Ideally, the proportions, angles, and curves of the safety adaptor should match the corresponding parts of the dock cleat, but to be functional it is only necessary that the height and width of the adaptor match that of the cleat so that there are no catch points extending beyond the protection of the safety adaptor.

Thus the scope of the invention should be determined by the appended claims and their legal equivalents, rather than the examples given.

I claim:

1. A device used in conjuction with the type of dock cleat which has two horizontally protruding horns and a surface for guiding a rope or dock line below each horizontally protruding horn comprising:

a. a smooth sloping surface shaped and positioned so said device will deflect a moving object such as a foot away from said horizontally protruding horn of a dock cleat, b. a concavely curved surface shaped so that said device can be used to guide a rope or docking line and positioned facing said guiding surface on the dock cleat so that said rope or docking line can be guided from either direction without removing the rope from the cleat.

* * * * *